US012709514B2

(12) United States Patent
Woo et al.

(10) Patent No.: US 12,709,514 B2
(45) Date of Patent: Aug. 18, 2026

(54) POWER TRANSMISSION STRUCTURE OF MEDIA SEPARATION UNIT

(71) Applicant: HYOSUNG TNS INC., Seoul (KR)

(72) Inventors: Hyun Sik Woo, Seoul (KR); Dong Kyung Kim, Gyeonggi-do (KR)

(73) Assignee: HYOSUNG TNS INC., Seoul (KR)

( * ) Notice: Subject to any disclaimer, the term of this patent is extended or adjusted under 35 U.S.C. 154(b) by 0 days.

(21) Appl. No.: 18/999,229

(22) Filed: Dec. 23, 2024

(65) Prior Publication Data

US 2025/0214806 A1 Jul. 3, 2025

(51) Int. Cl.
*B65H 79/00* (2006.01)
*B65H 3/04* (2006.01)

(52) U.S. Cl.
CPC ..... *B65H 79/00* (2013.01); *B65H 3/04* (2013.01); *B65H 2403/40* (2013.01); *B65H 2403/722* (2013.01)

(58) Field of Classification Search
CPC ..... B65H 2701/1912; B65H 3/0684; B65H 3/0669; B65H 2403/40; G07D 2211/00; G07D 11/22; G07D 11/235; G07D 11/18; G07D 11/17; G07D 11/16
See application file for complete search history.

(56) References Cited

FOREIGN PATENT DOCUMENTS

| | | | | |
|---|---|---|---|---|
| CN | 204965585 U | | 1/2016 | |
| KR | 101628472 B1 | | 6/2016 | |
| KR | 1020200050409 A | | 5/2020 | |
| KR | 1020200082845 A | | 7/2020 | |
| KR | 20220050410 A | * | 4/2022 | ..... G07D 11/50 |

OTHER PUBLICATIONS

Machine translation of KR-20220050410-A. (Year: 2022).*
Allowance issued on Aug. 14, 2025, in corresponding application No. KR 10-2023-0193802.

* cited by examiner

*Primary Examiner* — Randell J Krug
(74) *Attorney, Agent, or Firm* — BACON & THOMAS, PLLC

(57) ABSTRACT

One embodiment provides a power transmission structure of a media separation unit, the power transmission structure including a pickup pulley and a feed pulley that are provided at positions spaced apart at both sides; a media separation belt configured to travel along the pickup pulley and the feed pulley, grip and convey media, and have a slope that changes due to contact with a bill press configured to support the media and move upward or downward at a lower side of the pickup pulley; a motor configured to provide a driving force for the media separation belt to rotate in one direction or the other direction; at least one relay gear configured to transmit the driving force of the motor; a swing arm configured to swing in both direction within a predetermined angle range in conjunction with rotation of the relay gear; a swing gear configured to be connected to the swing arm and rotate in conjunction with the rotation of the relay gear to transmit power for the swing arm to swing; and a clutch gear configured to intermittently be coupled to or released from the swing gear according to a swing direction of the swing arm and configured to transmit power to the pickup pulley through a connection belt, whose slope changes in conjunction with a change in the slope of the media separation belt.

10 Claims, 6 Drawing Sheets

[FIG. 2]
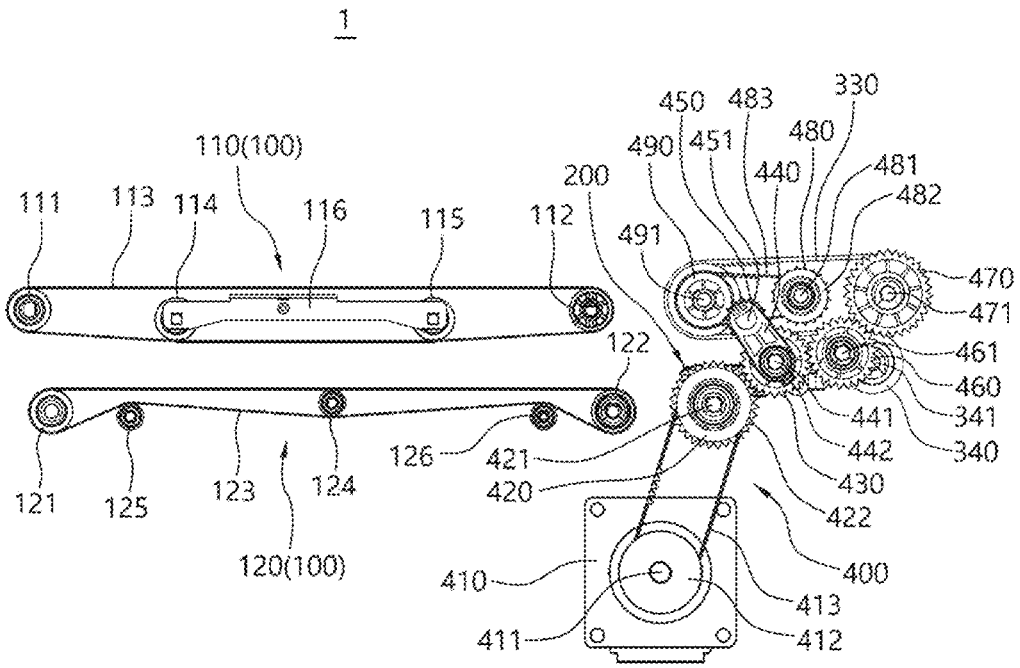

[FIG. 3]
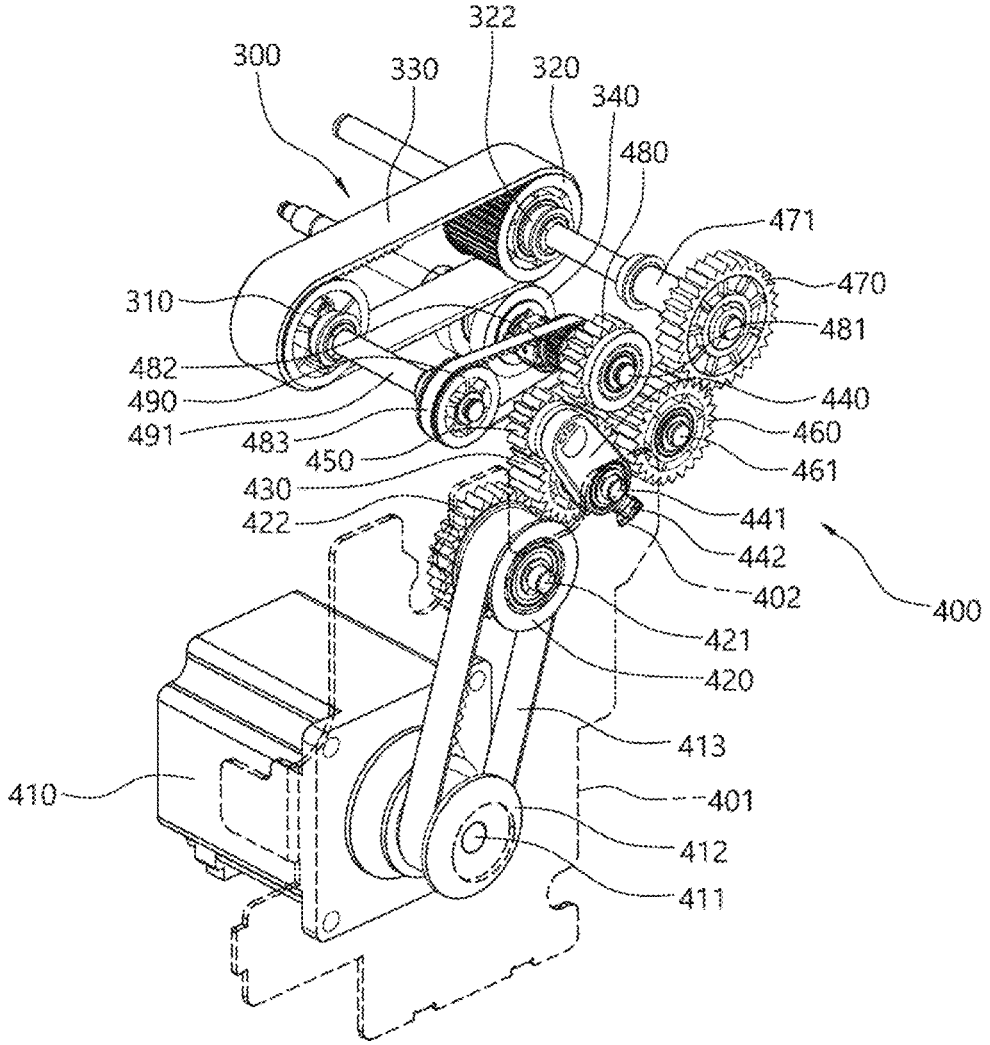

[FIG. 4]
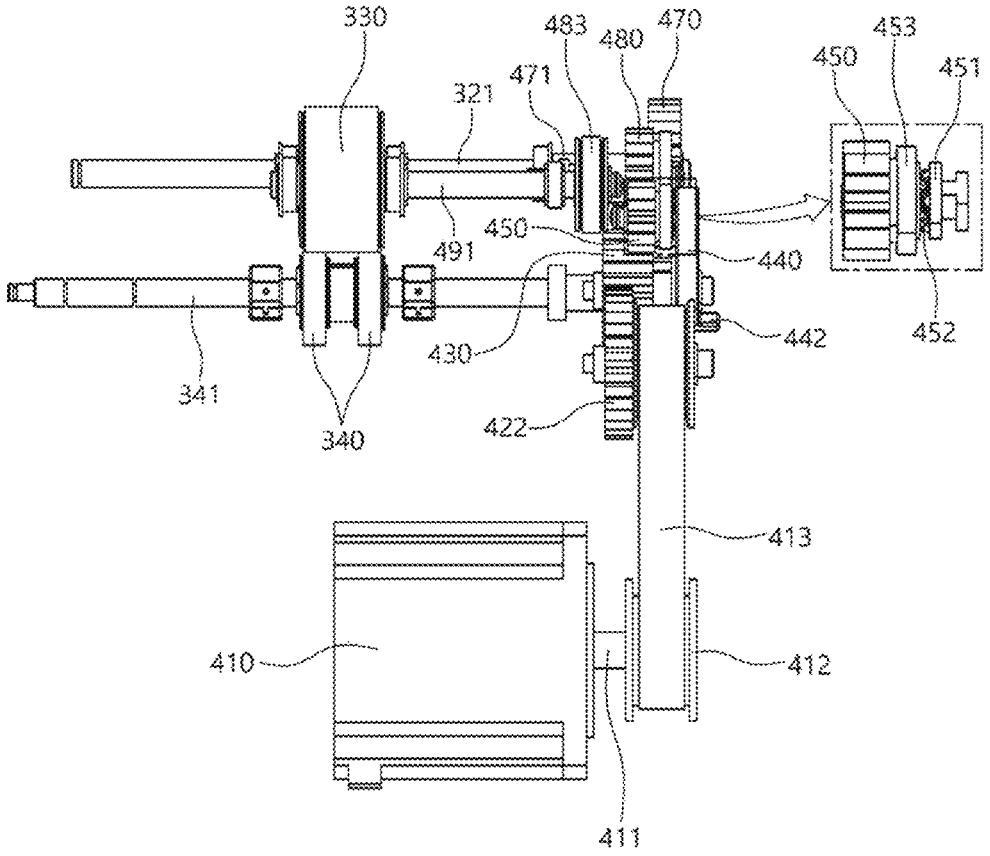

[FIG. 5]
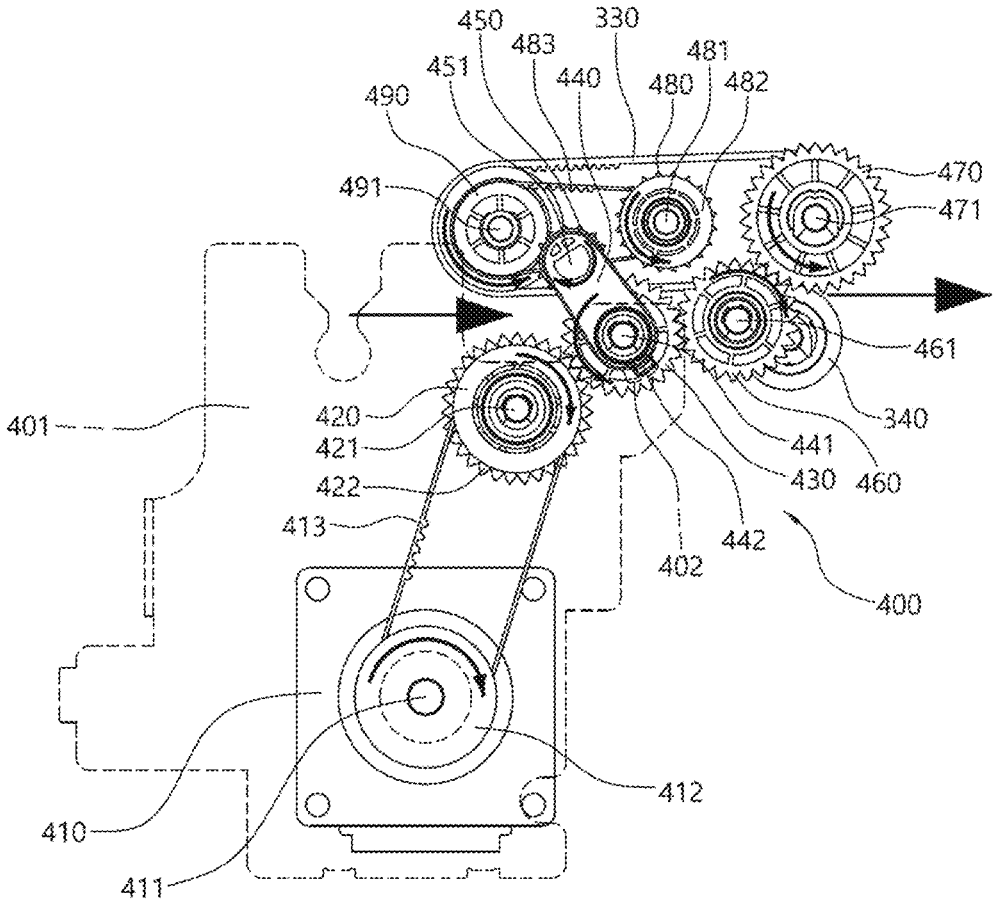

[FIG. 6]
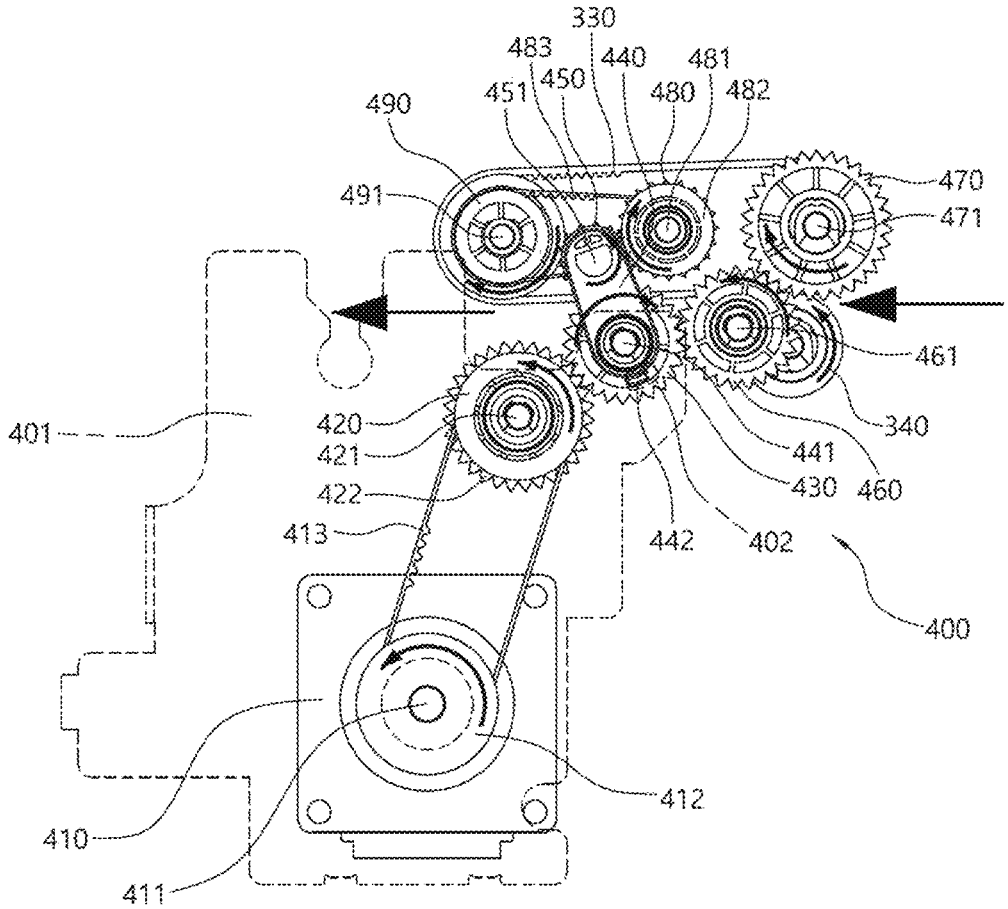

POWER TRANSMISSION STRUCTURE OF MEDIA SEPARATION UNIT

BACKGROUND

1. Field of the Invention

The present invention relates to a power transmission structure of a media separation unit, and more particularly, to a power transmission structure of a media separation unit that can provide a driving force for media to be conveyed in both directions and can smoothly switch power transmission according to a media conveying direction.

2. Discussion of Related Art

Conventional automated teller machines are devices developed in relation to financial services to promptly and conveniently provide most financial services, excluding a financial advisory service, in an unmanned manner regardless of time. Examples of conventional automated teller machines include a cash dispenser unit (CDU), a bill recycling machine (BRM), and a cash and check in module (CCIM) that can simultaneously process deposition or rejection of media such as multiple banknotes or checks in bundles.

A conventional media deposit machine includes configurations of a bundle module for feeding and receiving media in bundles and a media separation unit for separating the media fed into the bundle module into individual sheets of media.

The media separation unit includes a pickup pulley and a feed pulley that are provided at positions spaced apart at both sides, a media separation belt configured to travel along the pickup pulley and the feed pulley, separate media into individual sheets of media, and convey the media, and a gate roller provided to come into contact with the media separation belt at a lower side of the feed pulley, provided to not rotate in a deposit direction but rotate in an opposite direction thereof, and configured to apply a frictional force to allow the media to be separated into individual sheets of media.

The feed pulley is provided to rotate in place, and the pickup pulley is provided to be able to move upward and downward within a predetermined clearance range in a vertical direction.

A bill press is provided to be able to move upward and downward at a lower side of the pickup pulley.

When the bill press moves upward and causes the pickup pulley to move upward, the pickup pulley is located at the same height as the feed pulley, and at this time, the media separation belt is horizontally located, and a lower surface of the media separation belt is able to entirely grip an upper surface of semi-separated media.

When the bill press moves downward, the pickup pulley moves downward and is located at a lower height than the feed pulley, and at this time, the media separation belt reaches a state in which it is tilted at a predetermined angle. When the media separation belt is driven to rotate in this state, among the semi-separated media stacked on an upper surface of the bill press, a sheet of media that is located at an uppermost end can be picked up and separated each time.

A swing gear provided in the media separation unit of the conventional media deposit machine is configured to switch between an on-state in which it is coupled to a gear connected to the pickup pulley according to driving in one direction or the other direction of a motor and an off-state in which it is released therefrom. However, when the swing gear and the gear connected to the pickup pulley are strongly engaged with each other in the on-state in which they are coupled to each other, there is a problem in that power transmission is not performed because the state in which the swing gear and the gear connected to the pickup pulley are engaged with each other is maintained without the swing gear smoothly switching to the off-state in which it is released from the gear connected to the pickup pulley.

The related art of the media deposit machine is published in Korean Patent Registration No. 10-1545480.

SUMMARY OF THE INVENTION

The present invention is directed to providing a power transmission structure of a media deposit machine that can provide a driving force for media to be conveyed in both directions and can smoothly switch power transmission according to a media conveying direction.

According to an aspect of the present invention, there is provided a power transmission structure of a media separation unit, the power transmission structure comprising: a pickup pulley and a feed pulley that are provided at positions spaced apart at both sides; a media separation belt configured to travel along the pickup pulley and the feed pulley, grip and convey media, and have a slope that changes due to contact with a bill press configured to support the media and move upward or downward at a lower side of the pickup pulley; a motor configured to provide a driving force for the media separation belt to rotate in one direction or the other direction; at least one relay gear configured to transmit the driving force of the motor; a swing arm configured to swing in both direction within a predetermined angle range in conjunction with rotation of the relay gear; a swing gear configured to be connected to the swing arm and rotate in conjunction with the rotation of the relay gear to transmit power for the swing arm to swing; and a clutch gear configured to intermittently be coupled to or released from the swing gear according to a swing direction of the swing arm and configured to transmit power to the pickup pulley through a connection belt, whose slope changes in conjunction with a change in the slope of the media separation belt.

Wherein, when the swing arm swings in one direction and the swing gear is separated from the clutch gear, the driving force of the motor is not transmitted to the pickup pulley; and when the swing arm swings in the other direction and the swing gear is coupled to the clutch gear, the driving force of the motor is transmitted to the pickup pulley.

Wherein, one side portion of the swing arm is coupled to a rotating shaft of the relay gear; and the swing gear is rotatably coupled to the other side portion of the swing arm in a state in which the swing gear is coupled to the relay gear.

Wherein, a leaf spring configured to apply a predetermined frictional force is interposed between the swing arm and the swing gear, and the swing arm swings in conjunction with rotation of the swing gear caused by the rotation of the relay gear.

Wherein, the motor provides a deposit direction driving force by which the media separation belt is rotated in the one direction and a withdrawal direction driving force by which the media separation belt is rotated in the other direction; the driving force of the motor is transmitted to the feed pulley through the relay gear; and a one-way bearing configured to transmit the deposit direction driving force of the motor to the feed pulley and block the withdrawal direction driving force of the motor so that it is not transmitted to the feed pulley is coupled between the feed pulley and the rotating shaft of the feed pulley.

Wherein, when the swing arm swings in the one direction and the swing gear is separated from the clutch gear due to driving of the motor in a deposit direction, the driving force of the motor is transmitted to the feed pulley, and the feed pulley is driven to rotate due to an action of the one-way bearing; and when the swing arm swings in the other direction and the swing gear is coupled to the clutch gear due to driving of the motor in a withdrawal direction, the driving force of the motor is transmitted to the pickup pulley, the pickup pulley is driven to rotate, and the feed pulley idly rotates due to the action of the one-way bearing.

Wherein, as configurations for limiting a swing angle of the swing arm, the power transmission structure further comprises a stopper protrusion formed on the relay gear and a frame in which a stopper hole having a circular arc shape, into which the stopper protrusion is inserted, is formed.

Wherein, the relay gear includes a first relay gear to which the swing arm is coupled, a second relay gear coupled to one side of the first relay gear, and a third relay gear coupled to one side of the second relay gear and coupled to a rotating shaft which is the same as a rotating shaft of the feed pulley.

Wherein, a clutch pulley is coupled to a rotating shaft of the clutch gear; a connection pulley is coupled to a rotating shaft of the pickup pulley; and the connection belt is provided to travel along the clutch pulley and the connection pulley.

Wherein, in conjunction with upward or downward movement of the bill press, a slope of the media separation belt is changed due to the media separation belt vertically rotating about the rotating shaft of the feed pulley, and a slope of the connection belt is changed due to the connection belt vertically rotating about the rotating shaft of the clutch gear.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 2 is a front view of FIG. 1;

FIG. 3 is a perspective view of a media separation unit and a power transmission unit that are illustrated in FIG. 1;

FIG. 4 is a top view of FIG. 3;

FIG. 5 is an operation state view of the power transmission unit during deposit of media in the media deposit machine according to the present invention; and FIG. 6 is an operation state view of the power transmission unit during discharge of media from the media deposit machine according to the present invention.

DETAILED DESCRIPTION OF EXEMPLARY EMBODIMENTS

Figure 1:
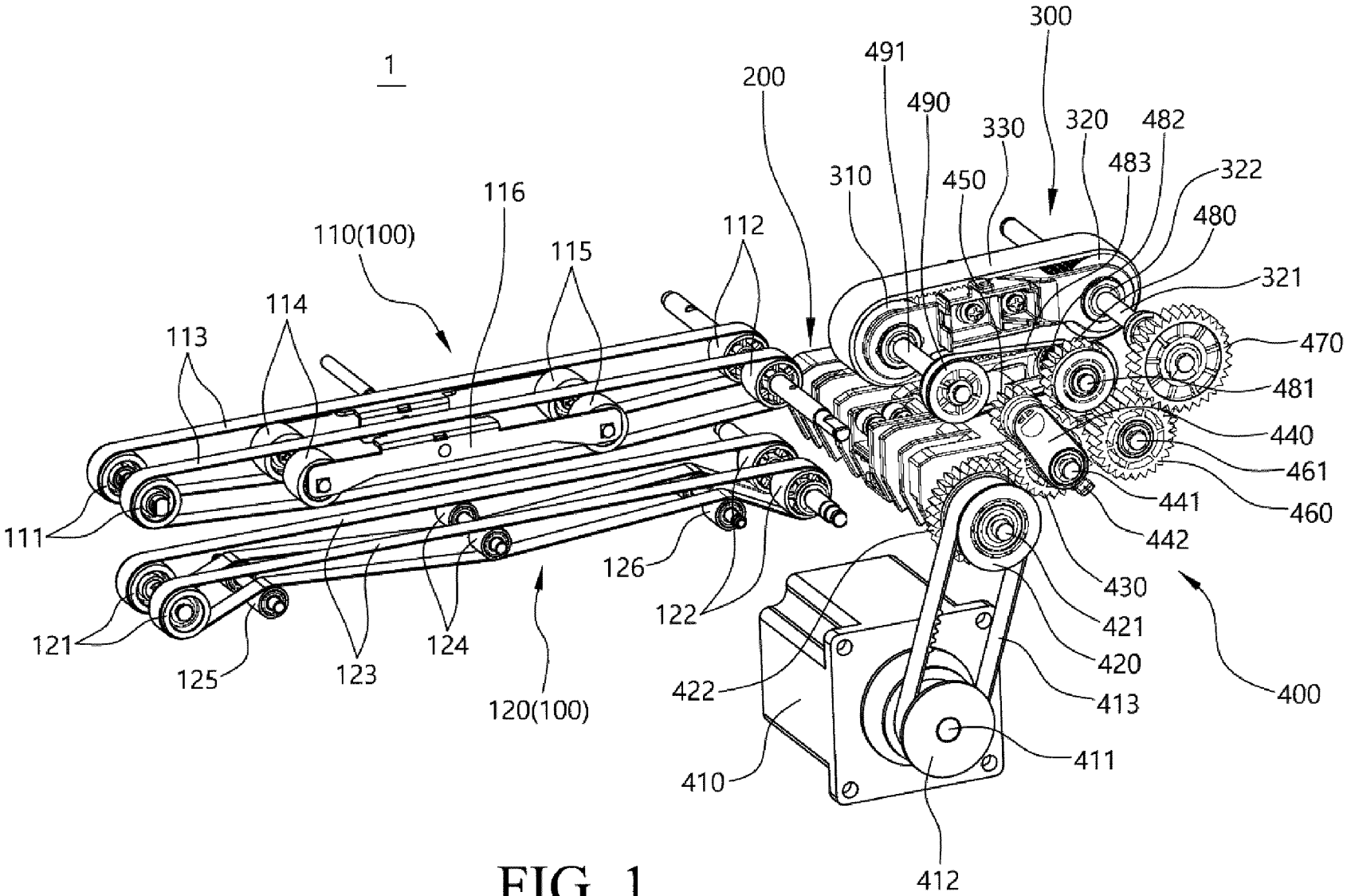
FIG. 1 is a perspective view of a main part of a media deposit machine according to the present invention.

Hereinafter, configurations and effects relating to exemplary embodiments of the present invention will be described in detail with reference to the accompanying drawings.

Referring to FIGS. 1 and 2, a media deposit machine 1 applied to the present invention includes a media conveyance unit 100, a bill press 200, a media separation unit 300, and a power transmission unit 400.

The media conveyance unit 100 includes a first media conveyance unit 110 provided at an upper portion of a media bundle, which is fed, to come into contact with an upper surface of the media bundle and a second media conveyance unit 120 provided at a lower portion of the media bundle, which is fed, to come into contact with a lower surface of the media bundle.

The first media conveyance unit 110 may include a pair of upper pulleys 111 and 112 provided at positions spaced apart at both sides, an upper conveyance belt 113 configured to travel along the pair of upper pulleys 111 and 112 and grip the upper surface of the media bundle, a plurality of upper tension rollers 114 and 115 configured to apply tension to the upper conveyance belt 113 downward toward the media bundle, and a link member 116 configured to connect the upper tension rollers 114 and 115.

The first media conveyance unit 110 may be driven to rotate in both directions, and based on FIG. 2, may be driven in a deposit direction in which the first media conveyance unit 110 is rotated counterclockwise and a withdrawal direction (rejection direction) in which the first media conveyance unit 110 is rotated clockwise.

The second media conveyance unit 120 may include a pair of lower pulleys 121 and 122 provided at positions spaced apart at both sides, a lower conveyance belt 123 configured to travel along the pair of lower pulleys 121 and 122 and grip the lower surface of the media bundle, a support roller 124 configured to support the lower conveyance belt 123, and a plurality of second tension rollers 125 and 126 configured to apply tension upward toward the media bundle.

The second media conveyance unit 120 may be driven to rotate in both directions, and based on FIG. 2, may be driven in a deposit direction in which the second media conveyance unit 120 is rotated clockwise and a rejection direction in which the second media conveyance unit 120 is rotated counterclockwise.

The second media conveyance unit 120 may move upward or downward in response to a change in a thickness according to the number of media in the media bundle that is fed. That is, since the media bundle is conveyed along a media conveyance path provided between the upper conveyance belt 113 and the lower conveyance belt 123, and the upper surface and the lower surface of the media bundle need to be gripped by the upper conveyance belt 113 and the lower conveyance belt 123, respectively, for stable conveyance, a height of the media conveyance path is configured to be adjustable in response to a change in a thickness of the media bundle according to an amount of upward or downward movement of the second media conveyance unit 120.

The bill press 200 is provided to move upward or downward while supporting a set number of media. That is, a stack space in which semi-separated media can be stacked is provided between the bill press 200 and a media separation belt 330 of the media separation unit 300, the bill press 200 is at a position at which it is moved downward in a standby state which is a state before the conveyance and arrival of media, and the bill press 200 moves upward to a set height in a state in which an operation of semi-separating media or an operation of separating a sheet of media is performed. As the bill press 200 moves upward and thus comes into contact with a pickup pulley 310 provided at an upper side thereof, the pickup pulley 310 and the media separation belt 330 coupled thereto are lifted upward or move downward due to the bill press 200.

The media separation unit 300 includes the pickup pulley 310 and a feed pulley 320 that are provided at positions spaced apart at both sides, the media separation belt 330 configured to travel along the pickup pulley 310 and the feed pulley 320, separate media into individual sheets of media, and convey the media, and a gate roller 340 provided to come into contact with the media separation belt 30 at a lower side of the feed pulley 320, provided to not rotate in a deposit direction but rotate in an opposite direction thereof, and configured to apply a frictional force to allow the media to be separated into individual sheets of media.

The feed pulley 320 is provided to rotate in place.

The pickup pulley 310 is provided to be able to move upward and downward within a predetermined clearance range in a vertical direction and is supported by an elastic member (not illustrated) to be pressed downward and apply a separation pressure.

When the bill press 200 moves upward and causes the pickup pulley 310 to move upward, the pickup pulley 310 is located at the same height as the feed pulley 320, and at this time, the media separation belt 330 is horizontally located, and a lower surface of the media separation belt 330 is able to entirely grip an upper surface of semi-separated media.

When the bill press 200 moves downward, the pickup pulley 310 moves downward due to the elastic member (not illustrated) and is located at a lower height than the feed pulley 320.

At this time, based on FIG. 2, the media separation belt 330 reaches a state in which it is tilted at a predetermined angle downward to the left. When the media separation belt 330 is driven to rotate in this state, among the semi-separated media stacked on an upper surface of the bill press 200, a sheet of media that is located at an uppermost end can be picked up and separated each time.

The power transmission unit 400 serves to transmit power for driving rotation of the pickup pulley 310, the feed pulley 320, and the media separation belt 330 of the media separation unit 300. The media separation belt 330 is rotated in one direction to separate and convey a sheet of media in a deposit direction at the time of insertion (deposit) of media and is rotated in the other direction to convey the media in a withdrawal direction at the time of withdrawal (rejection) of media.

Referring to FIGS. 3 and 4, the power transmission unit 400 includes a motor 410, one or more relay gears 430, 460, and 470, a swing arm 440, a swing gear 450, and a clutch gear 480.

The motor 410 provides a driving force for the media separation belt 330 to be rotated in one direction or the other direction. That is, the motor 410 provides a deposit direction driving force by which the media separation belt 330 is rotated in one direction and a withdrawal direction driving force by which the media separation belt 330 is rotated in the other direction.

A driving pulley 412 may be coupled to a motor shaft 411 of the motor 410, a driven shaft 421 and a driven pulley 420 and a driven gear 422, which are coupled to the driven shaft 421, may be provided at positions spaced apart upward from an upper side of the driving pulley 412, and power may be transmitted to the driving pulley 412 and the driven pulley 420 by a driving belt 413.

The one or more relay gears 430, 460, and 470 are coupled to the driven gear 422 to transmit a driving force of the motor 410. In one embodiment, the relay gears 430, 460, and 470 may include a first relay gear 430 coupled to one side of the driven gear 422, a second relay gear 460 coupled to one side of the first relay gear 430, and a third relay gear 470 coupled to one side of the second relay gear 460 and coupled to a rotating shaft 471 which is the same as a rotating shaft 321 of the feed pulley 320.

The swing arm 440 configured to swing in both directions within a predetermined angle range in conjunction with rotation of the first relay gear 430 is coupled to a rotating shaft 441 of the first relay gear 430.

The swing gear 450 configured to rotate in conjunction with rotation of the first relay gear 430 and transmit power for the swing arm 440 to swing is coupled to the swing arm 440.

The clutch gear 480 configured to intermittently be coupled to or released from the swing gear 450 according to a swing direction of the swing arm 440 and configured to transmit power to the pickup pulley 310 through a connection belt 483, whose slope changes in conjunction with a change in a slope of the media separation belt 330, is provided at one side of the swing gear 450.

One side portion of the swing arm 440 is coupled to the rotating shaft 441 of the first relay gear 430, and the swing gear 450 is rotatably coupled to the other side portion of the swing arm 440 in a state in which the swing gear 450 is coupled to the first relay gear 430.

A clutch pulley 482 is coupled to a rotating shaft 481 of the clutch gear 480, a connection pulley 490 is coupled to a rotating shaft 491 of the pickup pulley 310, and the connection belt 483 is provided to travel along the clutch pulley 482 and the connection pulley 490.

In conjunction with the upward or downward movement of the bill press 200, a slope of the media separation belt 330 may be changed due to the media separation belt 330 vertically rotating about the rotating shaft 321 of the feed pulley 320, and a slope of the connection belt 483 may be changed due to the connection belt 483 vertically rotating about the rotating shaft 481 of the clutch gear 480.

As illustrated in FIG. 5, when the swing arm 440 swings in one direction, causing coupling between the swing gear 450 and the clutch gear 480 to be released and the swing gear 450 and the clutch gear 480 to be separated from each other, a driving force of the motor 410 is not transmitted to the pickup pulley 310. As illustrated in FIG. 6, when the swing arm 440 swings in the other direction, causing the swing gear 450 to be coupled to the clutch gear 480, the driving force of the motor 410 may be transmitted to the pickup pulley 310.

As illustrated in FIG. 4, a leaf spring 452 configured to apply a predetermined frictional force may be interposed between the swing arm 440 and the swing gear 450, and a leaf spring contact member 451 and a leaf spring support member 453 may be provided at both side surfaces of the leaf spring 452. Due to the predetermined frictional force applied by the leaf spring 452, the swing arm 440 may swing in one direction or the other direction about the swing arm rotating shaft 441 in conjunction with rotation of the swing gear 450 according to rotation of the first relay gear 430.

When the frictional force by the leaf spring 452 is not applied, even when the first relay gear 430 receives the driving force of the motor 410 and rotates, the swing gear 450 coupled to the first relay gear 430 only idly rotates and does not apply a force pushing the swing gear 440 in the swing direction, and thus swinging of the swing gear 440 does not occur.

As configurations for limiting a swing angle of the swing arm 440, the power transmission unit 400 may further include a stopper protrusion 442 formed on the first relay gear 430 and a frame 401 in which a stopper hole 402 having a circular arc shape, into which the stopper protrusion 442 is inserted, is formed. When the swing arm 440 swings in one direction or the other direction, the stopper protrusion 442 may be caught at one side end or the other side end of the stopper hole 402, thereby limiting an angle range in which the swing arm 440 swings.

Meanwhile, the driving force of the motor 410 is transmitted to the feed pulley 320 through the first to third relay gears 430, 460, and 470. A one-way bearing 322 (see FIG. 3) configured to transmit the deposit direction driving force of the motor 410 to the feed pulley 320 and block the withdrawal direction driving force of the motor 410 so that it is not transmitted to the feed pulley 320 is coupled between the feed pulley 320 and the rotating shaft 321 of the feed pulley 320.

As illustrated in FIG. 5, when the swing arm 440 swings in one direction (counterclockwise) and the swing gear 450 is separated from the clutch gear 480 due to driving of the motor 410 in the deposit direction, the driving force of the motor 410 may be transmitted to the feed pulley 320, and the feed pulley 320 may be driven to rotate due to the action of the one-way bearing 322. That is, at the time of deposit of media, the driving force of the motor 410 is transmitted to the feed pulley 320, and due to driving of the feed pulley 320, the media separation belt 330 rotates in the deposit direction of the media.

As illustrated in FIG. 6, when the swing arm 440 swings in the other direction (clockwise) and the swing gear 450 is coupled to the clutch gear 480 due to driving of the motor 410 in the withdrawal direction, the driving force of the motor 410 may be transmitted to the pickup pulley 310, the pickup pulley 310 may be driven to rotate, and the feed pulley 320 may idly rotate due to the action of the one-way bearing 322. That is, at the time of withdrawal (rejection) of media, the driving force of the motor 410 is transmitted to the pickup pulley 310, and due to driving of the pickup pulley 310, the media separation belt 330 rotates in the withdrawal direction of the media.

According to the power transmission structure of the media separation unit according to the present invention, since the swing gear 450 provided at the swing arm 440 is configured to be coupled to or released from the clutch gear 480 connected to the pickup pulley 310 through the connection belt 483 even when the height at which the pickup pulley 310 is located is changed due to the upward or downward movement of the bill press 200, transmission of power to the pickup pulley 310 can be smoothly regulated.

In addition, since the media separation belt 330 is driven to rotate in one direction due to driving of the feed pulley 320 during media separation and deposit operations, and the media separation belt 330 is driven to rotate in the other direction due to driving of the pickup pulley 310 during a media withdrawal operation, the media separation belt 330 is able to apply a conveyance force that pulls media at a front end side in a media conveying direction, and thus it is possible to stably convey the media.

A power transmission structure of a media separation unit according to the present invention is configured so that, even when a height at which a pickup pulley is located is changed due to upward or downward movement of a bill press, a swing gear provided at a swing arm is coupled to or released from a clutch gear connected to the pickup pulley through a connection belt, and thus it is possible to smoothly regulate a driving force of a motor that is transmitted to the pickup pulley.

In addition, since a media separation belt is driven to rotate in one direction due to driving of a feed pulley during media separation and deposit operations, and the media separation belt is driven to rotate in the other direction due to driving of the pickup pulley during a media withdrawal operation, the media separation belt is able to apply a conveyance force that pulls media at a front end side in a media conveying direction, and thus it is possible to stably convey the media.

Exemplary embodiments of the present invention have been described in detail above, but the present invention is not limited to the embodiments described above. Various modifications are possible within the scope of the claims and the detailed description and accompanying drawings of the invention, and such modifications also fall within the present invention.

What is claimed is:

1. A power transmission structure of a media separation unit, the power transmission structure comprising:

a pickup pulley and a feed pulley that are spaced apart;

a media separation belt configured to travel along the pickup pulley and the feed pulley, grip and convey media, and have a slope that changes due to contact with a bill press configured to support the media and move upward or downward at a lower side of the pickup pulley;

a motor configured to provide a driving force for the media separation belt to rotate in a first direction or a second direction opposite to the first direction;

at least one relay gear configured to transmit the driving force of the motor;

a swing arm configured to swing in a first rotational direction and a second rotational direction within a predetermined angle range in conjunction with rotation of the at least one relay gear;

a swing gear configured to be connected to the swing arm and rotate in conjunction with the rotation of the at least one relay gear to transmit power for the swing arm to swing; and a clutch gear configured to intermittently be coupled to or released from the swing gear according to a swing direction of the swing arm and configured to transmit power to the pickup pulley through a connection belt, wherein a slope of the connection belt changes in conjunction with a change in a slope of the media separation belt.

2. The power transmission structure of claim 1, wherein:

when the swing arm swings in a first rotational direction and the swing gear is separated from the clutch gear, the driving force of the motor is not transmitted to the pickup pulley; and when the swing arm swings in a second rotational direction opposite to the first rotational direction and the swing gear is coupled to the clutch gear, the driving force of the motor is transmitted to the pickup pulley.

3. The power transmission structure of claim 1, wherein:

a first side portion of the swing arm is coupled to a rotating shaft of the at least one relay gear; and the swing gear is rotatably coupled to a second side portion of the swing arm in a state in which the swing gear is coupled to the at least one relay gear.

4. The power transmission structure of claim 2, wherein a leaf spring configured to apply a predetermined frictional force is interposed between the swing arm and the swing gear, and the swing arm swings in conjunction with rotation of the swing gear caused by the rotation of the at least one relay gear.

5. The power transmission structure of claim 1, wherein:

the motor provides a deposit direction driving force by which the media separation belt is rotated in the first rotational direction and a withdrawal direction driving force by which the media separation belt is rotated in the second rotational direction;

the driving force of the motor is transmitted to the feed pulley through the at least one relay gear; and a one-way bearing configured to transmit the deposit direction driving force of the motor to the feed pulley and block the withdrawal direction driving force of the motor so that it is not transmitted to the feed pulley is coupled between the feed pulley and the rotating shaft of the feed pulley.

6. The power transmission structure of claim 5, wherein:

when the swing arm swings in the first rotational direction and the swing gear is separated from the clutch gear due to driving of the motor in a deposit direction, the driving force of the motor is transmitted to the feed pulley, and the feed pulley is driven to rotate due to an action of the one-way bearing; and when the swing arm swings in the second rotational direction and the swing gear is coupled to the clutch gear due to driving of the motor in a withdrawal direction, the driving force of the motor is transmitted to the pickup pulley, the pickup pulley is driven to rotate, and the feed pulley idly rotates due to the action of the one-way bearing.

7. The power transmission structure of claim 1, wherein, for limiting a swing angle of the swing arm, the power transmission structure further comprises:

a stopper protrusion formed on the at least one relay gear; and a frame in which a stopper hole having a circular arc shape, into which the stopper protrusion is inserted, is formed.

8. The power transmission structure of claim 1, wherein the at least one relay gear includes a first relay gear to which the swing arm is coupled, a second relay gear coupled to a first side of the first relay gear, and a third relay gear coupled to a second side of the second relay gear; and wherein the third relay gear and the feed pulley are coupled to a common rotating shaft.

9. The power transmission structure of claim 1, wherein:

a clutch pulley is coupled to a rotating shaft of the clutch gear;

a connection pulley is coupled to a rotating shaft of the pickup pulley; and the connection belt is provided to travel along the clutch pulley and the connection pulley.

10. The power transmission structure of claim 9, wherein, in conjunction with upward or downward movement of the bill press, a slope of the media separation belt is changed due to the media separation belt vertically rotating about the rotating shaft of the feed pulley, and a slope of the connection belt is changed due to the connection belt vertically rotating about the rotating shaft of the clutch gear.

* * * * *